US009785098B2

(12) United States Patent
Nakaegawa et al.

(10) Patent No.: US 9,785,098 B2
(45) **Date of Patent: *Oct. 10, 2017**

(54) IMAGE FORMING APPARATUS WITH COMMON POWER SOURCE FOR PRIMARY TRANSFER AND SECONDARY TRANSFER

(71) Applicant: CANON KABUSHIKI KAISHA, Tokyo (JP)

(72) Inventors: Tohru Nakaegawa, Nagareyama (JP); Masanori Shida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,984

(22) Filed: Mar. 9, 2016

(65) Prior Publication Data

US 2016/0299458 A1 Oct. 13, 2016

Related U.S. Application Data

(60) Division of application No. 14/505,615, filed on Oct. 3, 2014, now Pat. No. 9,329,532, which is a continuation of application No. PCT/JP2013/060759, filed on Apr. 3, 2013.

(30) Foreign Application Priority Data

Apr. 3, 2012 (JP) ..... 2012-085032
Apr. 3, 2012 (JP) ..... 2012-085034

(51) Int. Cl.
*G03G 15/16* (2006.01)
*G03G 15/01* (2006.01)

(52) U.S. Cl.
CPC ..... *G03G 15/1675* (2013.01); *G03G 15/0189* (2013.01); *G03G 15/1605* (2013.01); *G03G 2215/0132* (2013.01)

(58) Field of Classification Search
CPC ..... G05G 15/1605; G05G 15/0189; G05G 15/1675; G05G 2215/0132
USPC ..... 399/66
See application file for complete search history.

(56) References Cited

U.S. PATENT DOCUMENTS

| | | | |
|---|---|---|---|
| 5,287,146 A | 2/1994 | Uno et al. | |
| 6,294,305 B1 | 9/2001 | Kobayashi et al. | |
| 6,421,521 B2 | 7/2002 | Tanaka | |
| 6,618,565 B2 | 9/2003 | Tamiya et al. | |
| 6,829,450 B2 | 12/2004 | Tamiya et al. | |
| 6,954,597 B2 | 10/2005 | Choi | 399/55 |

(Continued)

FOREIGN PATENT DOCUMENTS

| | | |
|---|---|---|
| JP | H08-185015 A | 7/1996 |
| JP | 2001-175092 A | 6/2001 |

(Continued)

*Primary Examiner* — Susan Lee
(74) *Attorney, Agent, or Firm* — Fitzpatrick, Cella, Harper & Scinto

(57) ABSTRACT

In an image forming apparatus including a power source for forming a secondary-transfer electric field at a secondary-transfer position and for forming a primary-transfer electric field at a primary-transfer position by applying a voltage to a transfer member to pass a current through a constant-voltage element, a potential of an image portion is controlled depending on a detection result of a detecting member.

17 Claims, 7 Drawing Sheets

(56) References Cited

U.S. PATENT DOCUMENTS

| | | | | |
|---|---|---|---|---|
| 7,751,737 | B2 | 7/2010 | Ishida et al. | |
| 7,773,888 | B2 * | 8/2010 | Katsumi | G03G 15/5079 399/10 |
| 8,265,499 | B2 | 9/2012 | Sueoka | |
| 8,634,737 | B2 | 1/2014 | Nakaegawa | |
| 9,217,974 | B2 * | 12/2015 | Shida | G03G 15/0131 |
| 9,250,574 | B2 * | 2/2016 | Nakaegawa | G03G 15/1605 |
| 9,256,166 | B2 * | 2/2016 | Nakaegawa | G03G 15/1605 |
| 9,274,477 | B2 | 3/2016 | Nakaegawa et al. | |
| 9,329,532 | B2 * | 5/2016 | Nakaegawa | G03G 15/0189 |
| 2001/0031160 | A1 * | 10/2001 | Tanaka | G03G 15/0131 399/298 |
| 2003/0215251 | A1 | 11/2003 | Mochizuki et al. | |
| 2007/0147877 | A1 * | 6/2007 | Kim | G03G 15/0131 399/101 |
| 2007/0189787 | A1 * | 8/2007 | Hagiwara | G03G 15/0266 399/44 |
| 2009/0263149 | A1 | 10/2009 | Makino | |
| 2010/0209128 | A1 | 8/2010 | Sueoka | |
| 2012/0230707 | A1 | 9/2012 | Shigehiro | |
| 2013/0188980 | A1 | 7/2013 | Ito et al. | |
| 2015/0185666 | A1 | 7/2015 | Nakaegawa | |

FOREIGN PATENT DOCUMENTS

| | | | |
|---|---|---|---|
| JP | 2001-255761 | A | 9/2001 |
| JP | 2001-265135 | | 9/2001 |
| JP | 2003-035986 | A | 2/2003 |
| JP | 2003-280331 | A | 10/2003 |
| JP | 2006-259640 | A | 9/2006 |
| JP | 2010-191276 | | 9/2010 |
| JP | 2012-098709 | A | 5/2012 |
| KR | 10-2005-0038844 | | 4/2005 |
| RU | 2372635 | | 11/2009 |
| WO | 2012/046824 | | 4/2012 |

* cited by examiner

IMAGE FORMING APPARATUS WITH COMMON POWER SOURCE FOR PRIMARY TRANSFER AND SECONDARY TRANSFER

CROSS-REFERENCE TO RELATED APPLICATIONS

This application is a divisional application of U.S. application Ser. No. 14/505,615 filed Oct. 3, 2014, now U.S. Pat. No. 9,329,532, which is a continuing application of PCT/JP2013/060759 filed Apr. 3, 2013, which in turn claims benefit to Japanese priority applications No. 2012-085032 and 2012-085034, both filed Apr. 3, 2012.

TECHNICAL FIELD

The present invention relates to an image forming apparatus using an electrophotographic type, such as a copying machine, a printer or the like.

BACKGROUND ART

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-open Patent Application 2003-35986 discloses a conventional constitution of the intermediary transfer type. More particularly, in Japanese Laid-open Patent Application 2003-35986, in order to primary-transfer the toner image from the photosensitive member onto the intermediary transfer member, a primary-transfer roller is provided, and a power source exclusively for the primary-transfer is connected to the primary-transfer roller. Furthermore, in Japanese Laid-open Patent Application 2003-35986, in order to secondary-transfer the toner image from the intermediary transfer member onto the recording material, a secondary-transfer roller is provided, and a voltage source exclusively for the secondary-transfer is connected to the secondary-transfer roller.

In Japanese Laid-open Patent Application 2006-259640, there is a constitution in which a voltage source is connected to an inner secondary-transfer roller, and another voltage source is connected to the outer secondary-transfer roller. In Japanese Laid-open Patent Application 2006-259640, there is description to the effect that the primary-transfer of the toner image from the photosensitive member onto the intermediary transfer member is effected by voltage application to the inner secondary-transfer roller by the voltage source.

SUMMARY OF THE INVENTION

Problem to be Solved by Invention

However, when the voltage source exclusively for the primary-transfer is provided, there is a liability that it leads to an increase in cost, so that a method for omission of the voltage source exclusively for the primary-transfer is desired.

A constitution in which a voltage source exclusively for the primary-transfer is omitted, and the intermediary transfer member is grounded through a constant-voltage element to produce a predetermined primary-transfer voltage, has been found.

Means for Solving Problem

An image forming apparatus of the present invention includes a photosensitive member; an image forming portion for forming an electrostatic image on the photosensitive member to deposit a toner image on an image portion of the electrostatic image; an intermediary transfer member for carrying the toner image primary-transferred from the photosensitive member at a primary-transfer position; a transfer member, provided contactable to an outer peripheral surface of the intermediary transfer member, for secondary-transferring the toner image from the intermediary transfer member onto a recording material at a secondary-transfer position; a constant-voltage element, electrically connected between the intermediary transfer member and a ground potential, for maintaining a predetermined voltage by passing of a current therethrough; a power source for forming, by applying a voltage to the transfer member to pass the current through the constant-voltage element both of a secondary-transfer electric field at the secondary-transfer position and a primary-transfer electric field at the primary-transfer position; a detecting member for detecting an ambient condition; and a controller for controlling a potential of the image portion depending on a detection result of the detecting member.

On the other hand, for a reason such that a charging state of a toner changes in the case where an ambient condition changes, also a potential contrast at which the primary-transfer is optimally carried out changes. However, in the above constitution, a potential of the intermediary transfer member is fixed at a potential of the constant-voltage element, and therefore in the case where the ambient condition changes, there is a possibility that an inconvenience generates during the primary-transfer.

Effect of the Invention

According to the present invention, in a constitution in which a power source exclusively for the primary-transfer is omitted in order to reduce a cost, even when a voltage applied by a power source for the secondary-transfer is changed in order to properly carry out the secondary-transfer, it is possible to suppress generation of a primary-transfer defect.

EMBODIMENTS FOR CARRYING OUT INVENTION

Figure 1:
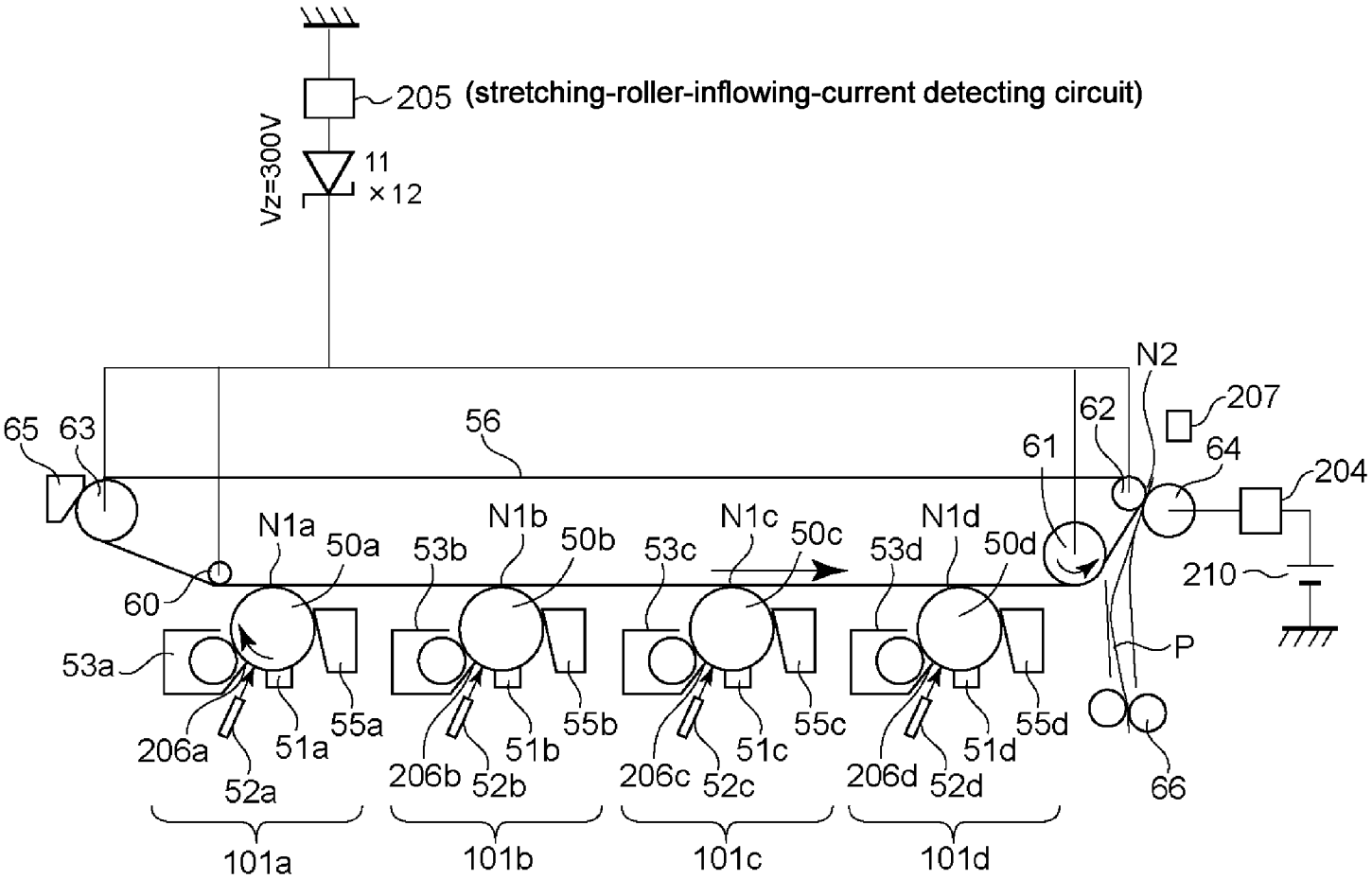
FIG. 1 is an illustration of a basic structure in Embodiment 1.

In the following, embodiments of the present invention will be described along the drawings. Incidentally, in each of the drawings, the same reference numerals are assigned to elements having the same structures or functions, and the redundant description of these elements is omitted.

Embodiment 1

[Image Forming Apparatus]

FIG. 1 shows an image forming apparatus in this embodiment. The image forming apparatus employs a tandem type in which image forming units for respective colors are independent and arranged in tandem. In addition, the image forming apparatus employs an intermediary transfer type in which toner images are transferred from the image forming units for respective colors onto an intermediary transfer member, and then are transferred from the intermediary transfer member onto a recording material.

Image forming units 101*a*, 101*b*, 101*c*, 101*d* are image forming means for forming yellow (Y), magenta (M), cyan (C) and black (K) toner images, respectively. These image forming units are disposed in the order of the image forming units 101*a*, 101*b*, 101*c* and 101*d*, that is, in the order of yellow, magenta, cyan and black from an upstream side with respect to a movement direction of an intermediary transfer belt 56.

The image forming units 101*a*, 101*b*, 101*c*, 101*d* include photosensitive drums 50*a*, 50*b*, 50*c*, 50*d* as photosensitive members (image bearing members), respectively, on which the toner images are formed. Primary chargers 51*a*, 51*b*, 51*c*, 51*d* are charging means for charging surfaces of the respective photosensitive drums 50*a*, 50*b*, 50*c*, 50*d*. Exposure devices 52*a*, 52*b*, 52*c*, 52*d* are provided with laser scanners to expose to light the photosensitive drums 50*a*, 50*b*, 50*c* and 50*d* charged by the primary chargers. By outputs of the laser scanners being rendered on and off on the basis of image information, electrostatic images corresponding to images are formed on the respective photosensitive drums. That is, the primary charger and the exposure means function as electrostatic image forming means for forming the electrostatic image on the photosensitive drum. Developing devices 53*a*, 53*b*, 53*c* and 53*d* are provided with accommodating containers for accommodating the yellow, magenta, cyan and black toner and are developing means for developing the electrostatic images on the photosensitive drum 50*a*, 50*b*, 50*c* and 50*d* using the toner.

The toner images formed on the photosensitive drums 50*a*, 50*b*, 50*c*, 50*d* are primary-transferred onto the intermediary transfer belt 56 in primary-transfer portions N1*a*, N1*b*, N1*c* and N1*d* (primary-transfer positions). In this manner, four color toner images are transferred superimposedly onto the intermediary transfer belt 56. The primary-transfer will be described in detail hereinafter.

Photosensitive member drum cleaning devices 55*a*, 55*b*, 55*c* and 55*d* remove residual toner remaining on the photosensitive drums 50*a*, 50*b*, 50*c* and 50*d* without transferring in the primary-transfer portions N1*a*, N1*b*, N1*c* and N1*d*.

The intermediary transfer belt 56 is a movable intermediary transfer member onto which the toner images are to be transferred from the photosensitive drums 1*a*, 1*b*, 1*c*, 1*d*. In this embodiment, the intermediary transfer belt 7 has a two layer structure including a base layer and a surface layer. The base layer is at an inner side and contacts the stretching member. The surface layer is at an outer surface side and contacts the photosensitive drum. The base layer comprises a resin material such as polyimide, polyamide, PEN, PEEK, or various rubbers, with a proper amount of an antistatic agent such as carbon black incorporated. The base layer of the intermediary transfer belt 56 is formed to have a volume resistivity of $10^6$-$10^8$ Ωcm thereof. In this embodiment, the base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm is applied. That is, the resistance of the base layer is lower than that of the surface layer.

The thickness of the surface layer is 1-10 μm. Of course, the thickness is not intended to be limited to these numerical values.

The inner peripheral surface of the intermediary transfer belt 56 is stretched by various rollers 60, 61, 62 and 63 as stretching members. Idler rollers 60 and 61 stretch the intermediary transfer belt 56 extending along an arrangement direction of the respective photosensitive drums 50*a*, 50*b*, 50*c* and 50*d*. A tension roller 63 is a tension roller for applying a predetermined tension to the intermediary transfer belt 56. In addition, the tension roller 63 functions also as a correction roller for preventing snaking motion of the intermediary transfer belt 56. A belt tension to the tension roller 63 is constituted so as to be approx. 5-12 kgf. By this belt tension applied, nips as primary-transfer portions N1*a*, N1*b*, N1*c* and N1*d* are formed between the intermediary transfer belt 56 and the respective photosensitive drums 50*a*-50*d*. The inner secondary-transfer roller 62 is drive by a motor excellent in constant speed property, and functions as a driving roller for circulating and driving the intermediary transfer belt 56.

The recording material is accommodated in a sheet tray for accommodating the recording material P. The recording material P is picked up by a pick-up roller at predetermined timing from the sheet tray and is fed to a registration roller 66. In synchronism with the feeding of the toner image on the intermediary transfer belt, the recording material P is fed by the registration roller 66 to the secondary-transfer portion N2 for transferring the toner image from the intermediary transfer belt onto the recording material.

The outer secondary-transfer roller 64 is a secondary-transfer member for forming the secondary-transfer portion N2 together with the inner secondary-transfer roller 62 by urging the inner secondary-transfer roller via the intermediary transfer belt 56. In outer secondary-transfer roller is disposed so as to sandwich the recording material together with the intermediary transfer belt 56 at the secondary-transfer position. A secondary-transfer high-voltage (power) source 210 is connected to the outer secondary-transfer roller 64, and is a voltage source (power source) as a voltage applying means for applying a voltage to the outer secondary-transfer roller 64.

When the recording material P is fed to the secondary-transfer portion N2, the secondary-transfer voltage of an opposite polarity to the toner is applied to the outer secondary-transfer roller, whereby the toner image is transferred from the intermediary transfer belt 56 onto the recording material.

Incidentally, the inner secondary-transfer roller 62 is formed with EPDM rubber. The inner secondary-transfer roller is set at 20 mm in diameter, 0.5 mm in rubber thickness and 70° in hardness (Asker-C). The outer secondary-transfer roller 64 includes an elastic layer formed of NBR rubber, EPDM rubber or the like, and a core metal. The outer secondary-transfer roller is formed to have a diameter of 24 mm.

With respect to a direction in which the intermediary transfer belt 56 moves, in a downstream side than the secondary-transfer portion N2, an intermediary transfer belt cleaning device 65 for removing a residual toner and paper powder which remain on the intermediary transfer belt 56 without being transferred onto the recording material at the secondary-transfer portion N2 is provided.

[Primary-Transfer Electric Field Formation in Primary-Transfer-High-Voltage-Less-System]

This embodiment employs a constitution in which the voltage source exclusively for the primary-transfer is omitted for cost reduction. Therefore, in this embodiment, in order to electrostatically primary-transfer the toner image from the photosensitive drum onto the intermediary transfer belt 56, the secondary-transfer voltage source 210 is used (hereinafter, this constitution is referred to as a primary-transfer-high-voltage-less-system).

However, in a constitution in which the roller for stretching the intermediary transfer belt is directly connected to the ground, even when the secondary-transfer voltage source 210 applies the voltage to the outer secondary-transfer roller 64, there is a liability that most of the current flows into the stretching roller side, and the current does not flow into the photosensitive drum side. That is, even when the secondary-transfer voltage source 210 applies the voltage, the current does not flow into the photosensitive drums 50*a*, 50*b*, 50*c* and 50*d* via the intermediary transfer belt 56, so that the primary-transfer electric field for transferring the toner image does not act between the photosensitive drums and the intermediary transfer belt.

Therefore, in order to cause a primary-transfer electric field action to act in the primary-transfer-high-voltage-less-system, it is desirable that passive elements are provided between each of the stretching rollers 60, 61, 62 and 63 and the ground so as to pass the current toward the photosensitive drum side.

As a result, a potential of the intermediary transfer belt becomes high, so that the primary-transfer electric field acts between the photosensitive drum and the intermediary transfer belt.

Incidentally, in order to form the primary-transfer electric field in the primary-transfer-high-voltage-less-system, there is a need to pass the current along the circumferential direction of the intermediary transfer belt by applying the voltage from the secondary-transfer voltage source 210. However, if a resistance of the intermediary transfer belt itself is high, a voltage drop of the intermediary transfer belt with respect to a movement direction (circumferential direction) in which the intermediary transfer belt moves becomes large. As a result, there is also a liability that the current is less liable to pass through the intermediary transfer belt along the circumferential direction toward the photosensitive drums 50*a*, 50*b*, 50*c* and 50*d*. For that reason, the intermediary transfer belt may desirably have a low-resistant layer. In this embodiment, in order to suppress the voltage drop in the intermediary transfer belt, the base layer of the intermediary transfer belt is formed so as to have a surface resistivity of $10^2$ Ω/square or more and $10^8$ Ω/square or less. Further, in this embodiment, the intermediary transfer belt has the two-layer structure. This is because by disposing the high-resistant layer as the surface layer, the current flowing into a non-image portion is suppressed, and thus a transfer property is further enhanced easily. Of course, the layer structure is not intended to be limited to this structure. It is also possible to employ a single-layer structure or a structure of three layers or more.

Next, by using (a) of FIG. 2, a primary-transfer contrast which is a difference between the potential of the photosensitive drum and the potential of the intermediary transfer belt will be described.

Figure 2:
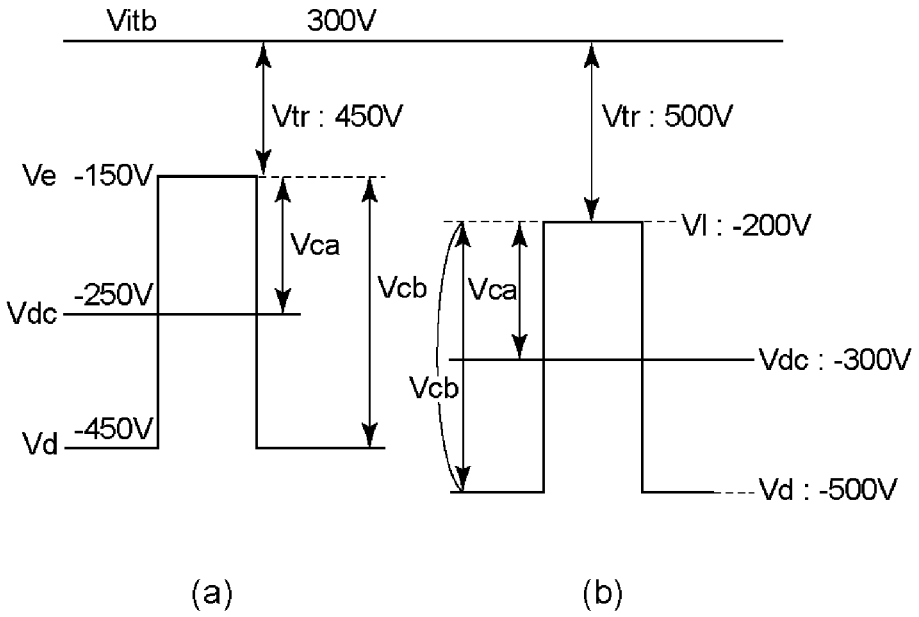
FIG. 2 is an illustration showing a relationship between a transferring potential and an electrostatic image potential in Embodiment 1.

(a) of FIG. 2 is the case where the surface of the photosensitive drum 1 is charged by the charging means 2, and the photosensitive drum surface has a potential Vd (−450 V in this embodiment). In addition, (a) of FIG. 2 is the case where the surface of the charged photosensitive drum is exposed to light by the exposure means 3, and the photosensitive drum surface has Vl (−150 V in this embodiment). The potential Vd is the potential of the non-image portion where the toner is not deposited, and the potential Vl is the potential of an image portion where the toner is deposited. Vitb shows the potential of the intermediary transfer belt.

The surface potential of the drum is controlled on the basis of a detection result of a potential sensor 206 provided in proximity to the photosensitive drum in a downstream side of the charging and exposure means and in upstream of the developing means.

The potential sensor detects the non-image portion potential and the image portion potential of the photosensitive drum surface, and controls a charging potential of the charging means on the basis of the non-image portion potential and controls an exposure light amount of the exposure means on the basis of the image portion potential.

By this control, with respect to the surface potential of the photosensitive drum, both potentials of the image portion potential and the non-image portion potential can be set at proper values.

With respect to this charging potential on the photosensitive drum, a developing bias Vdc (−250 V as a DC component in this embodiment) is applied by the developing device 4, so that a negatively charged toner is formed in the photosensitive drum side by development.

A developing contrast Vca which is a potential difference between the Vl of the photosensitive drum and the developing bias Vdc is: −150 (V)−(−250 (V))=100 (V).

An electrostatic image contrast Vcb which is a potential difference between the image portion potential Vl and the non-image portion potential Vd is: −150 (V)−(−450 (V))=300 (V).

A primary-transfer contrast Vtr which is a potential difference between the image portion potential Vl and the potential Vitb (300 V in this embodiment) of the intermediary transfer belt is: 300 V−(−150 (V))=450 (V).

Incidentally, in this embodiment, a constitution in which the potential sensor is disposed by attaching importance to accuracy of detection of the photosensitive drum potential is employed, but the present invention is not intended to be limited to this constitution. It is also possible to employ a constitution in which a relationship between the electrostatic image forming condition and the potential of the photosensitive drum is stored in ROM in advance by attaching importance to the cost reduction without disposing the potential sensor, and then the potential of the photosensitive drum is controlled on the basis of the relationship stored in the ROM.

[Zener Diode]

In the primary-transfer-high-voltage-less-system, the primary-transfer is determined by the primary-transfer contrast which is the potential difference between the potential of the intermediary transfer belt and the potential of the photosensitive drum. For that reason, in order to stably form the primary-transfer contrast, it is desirable that the potential of the intermediary transfer belt is kept constant.

Therefore, in this embodiment, Zener diode is used as a constant-voltage element disposed between the stretching roller and the ground.

Figure 3:
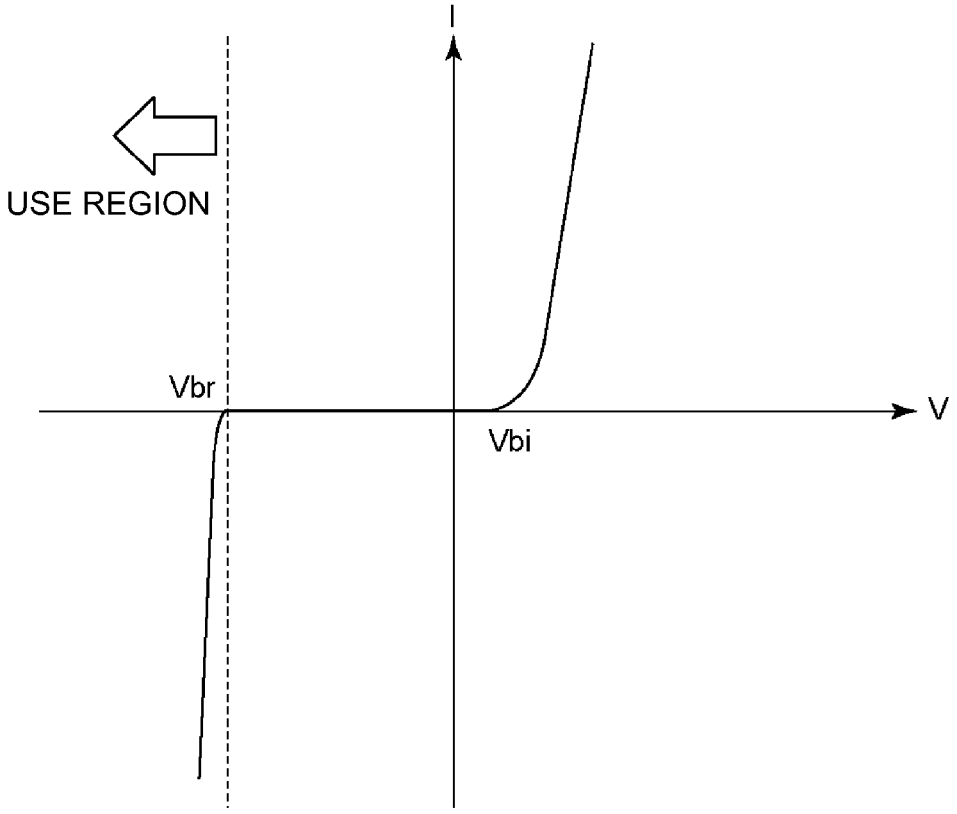
FIG. 3 is an IV characteristic of a Zener diode.

FIG. 3 shows a current-voltage characteristic of the Zener diode. The Zener diode causes the current to little flow until a voltage of Zener breakdown voltage Vbr or more is applied, but has a characteristic such that the current abruptly flows when the voltage of the Zener breakdown voltage or more is applied. That is, in a range in which the voltage applied to a Zener diode 11 is the Zener breakdown voltage or more, the voltage drop of the Zener diode 11 is such that the current is caused to flow so as to maintain a Zener voltage.

By utilizing such a current-voltage characteristic of the Zener diode, the potential of the intermediary transfer belt 56 is kept constant.

That is, in this embodiment, the Zener diode 11 is disposed as a passive element between the stretching rollers such as the idler rollers 60 and 61, the inner secondary-transfer roller 62 and the tension roller 63, and the ground.

In addition, during the primary-transfer, the secondary-transfer voltage source 210 applies the voltage not less than a predetermined voltage so that the voltage applied to the Zener diode 11 is kept at the Zener breakdown voltage. As a result, during the primary-transfer, the belt potential of the intermediary transfer belt 56 can be kept constant.

In this embodiment, between the stretching rollers and the ground, 12 pieces of the Zener diode 11 providing a standard value, of 25 V, of a Zener breakdown voltage Vbr are disposed in a state in which they are connected in series. That is, in the range in which the voltage applied to the Zener diode is kept at the Zener breakdown voltage, the potential of the intermediary transfer belt is kept constant at the sum of the standard values of the Zener breakdown voltages of the respective Zener diodes, i.e., 25×12=300 V.

Of course, the present invention is not intended to be limited to the constitution in which the plurality of Zener diodes are used. It is also possible to employ a constitution using only one Zener diode.

Of course, the surface potential of the intermediary transfer belt is not intended to be limited to a constitution in which the surface potential is 300 V. The surface potential may desirably be appropriately set depending on the species of the toner and a characteristic of the photosensitive drum.

In this way, when the voltage is applied by the secondary-transfer voltage source 210, the potential of the Zener diode maintains a predetermined potential, so that the primary-transfer electric field is formed between the photosensitive drum and the intermediary transfer belt. Further, similarly as the conventional constitution, when the voltage is applied by the secondary-transfer high-voltage source, the secondary-transfer electric field is formed between the intermediary transfer belt and the outer secondary-transfer roller.

[Zener Breakdown Voltage Detection]

In this embodiment, in order to discriminate whether the voltage applied to the Zener diode 11 is within a range in which the Zener breakdown voltage is maintained or out of the range, a stretching roller-inflowing-current detecting circuit 205 is provided. The stretching-roller-inflowing-current detecting circuit 205 is a current detecting means for detecting a current flowing into the ground via the Zener diode 11. During non-detection of the current by the stretching-roller-inflowing-current detecting circuit 205, the voltage applied to the Zener diode 11 is discriminated as being out of the range in which the Zener breakdown voltage is maintained. On the other hand, when the stretching roller inflowing current detecting circuit 205 detects the current, the voltage applied to the Zener diode 11 is discriminated as being within the range in which the Zener breakdown voltage is maintained.

Incidentally, this embodiment employs a constitution in which the stretching roller inflowing current detecting circuit detects the current by attaching importance to enhancement of accuracy such that a voltage value necessary to place the voltage applied to the Zener diode in the range in which the Zener breakdown voltage is maintained. Of course, this embodiment is not intended to be limited to this constitution. It is also possible to employ a constitution in which the voltage value for placing the voltage applied to the Zener diode 11 in the range in which the Zener breakdown voltage is maintained is stored in advance in ROM, not the constitution in which a discriminating function for detecting the current by the stretching-roller-inflowing-current detecting circuit is executed by attaching importance to suppression of a prolonged downtime.

[Controller]

Figure 4:
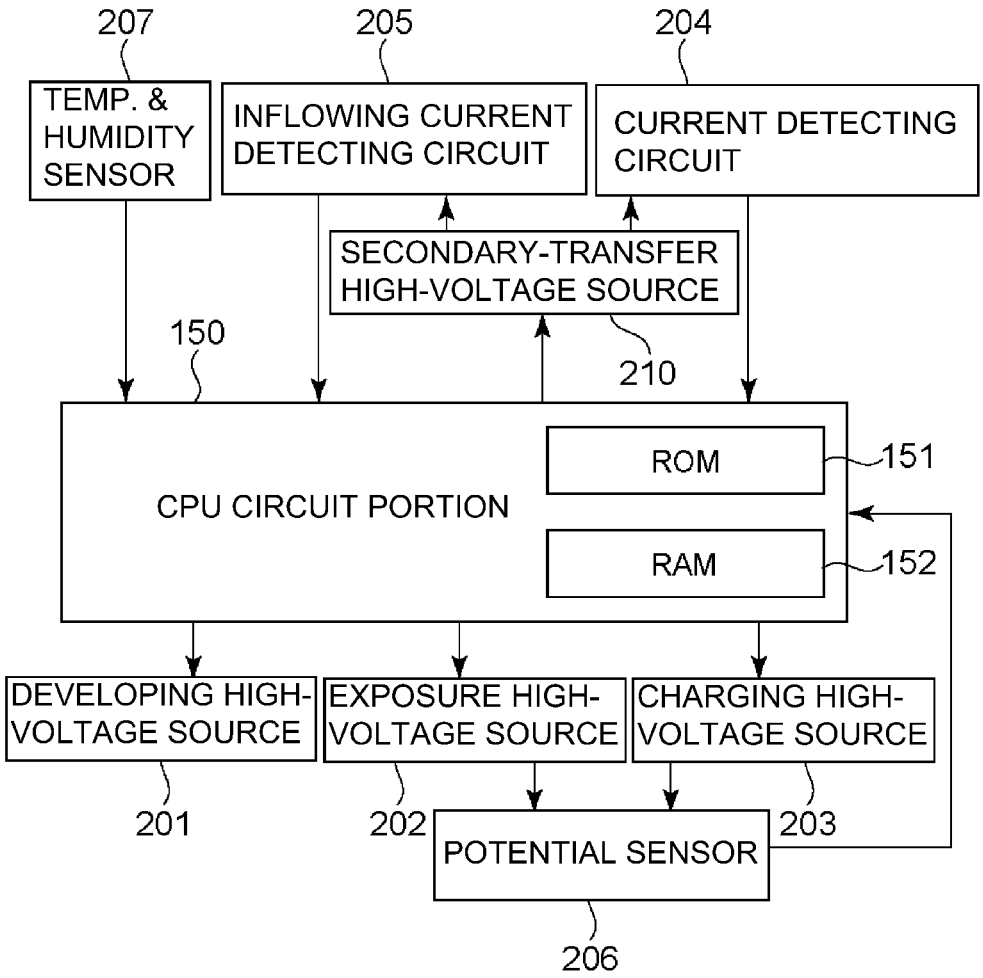
FIG. 4 is a block diagram in Embodiment 1.

A constitution of a controller for effecting control of the entire image forming apparatus will be described with reference to FIG. 4. The controller includes a CPU circuit portion 150 as shown in FIG. 4. The CPU circuit portion 150 incorporates therein CPU (not shown), ROM 151 and RAM 152. A secondary-transfer portion current detecting circuit 204 is a circuit (secondary-transfer current detecting means) for detecting a current passing through the outer secondary-transfer roller, the stretching-roller-inflowing-current detecting circuit 205 (Zener diode current detecting means) is a circuit for detecting a current flowing into the stretching roller, a potential sensor 206 is a sensor for detecting the potential of the photosensitive drum surface, and a temperature and humidity sensor 207 is a sensor for detecting a temperature and a humidity.

Into the CPU circuit portion 150, information from the secondary-transfer portion current detecting circuit 204, the stretching-roller-inflowing-current detecting circuit 205, the potential sensor 206 and the temperature and humidity sensor 207 is inputted. Then, the CPU circuit portion 150 effects integral control of the secondary-transfer voltage source 210, a developing high-voltage source 201, an exposure means high-voltage source 202 and a charging means high-voltage source 203 depending on control programs stored in the ROM 151. An environment table and a recording material thickness correspondence table which are described later are stored in the ROM 151, and are called up and reflected by the CPU. The RAM 152 temporarily hold control data, and is used as an operation area of arithmetic processing with the control.

[Control of Secondary-Transfer Voltage Source for Optimizing Secondary-Transfer Electric Field]

In order to optimize the secondary-transfer electric field for transferring the toner image from the intermediary transfer belt onto the recording material, the secondary-transfer voltage source 210 is controlled by the CPU circuit portion 150.

An optimum secondary-transfer electric field changes depending on an ambient condition and a species of the recording material.

Therefore, in this embodiment, in order to optimize the secondary-transfer electric field for transferring the toner image onto the recording material, an adjusting step which is called ATVC (Active Transfer Voltage Control) in which an adjusting voltage is applied is executed. The adjusting step for the secondary-transfer is executed by the CPU circuit portion 150 during non-secondary-transfer before the secondary-transfer step in which the toner image is transferred onto the recording material. That is, the CPU circuit portion 150 functions as an executing portion (adjusting portion) for executing the adjusting step for the secondary-transfer.

The ATVC as the adjusting step is carried out by applying a plurality of adjusting voltages, which are constant-voltage-controlled, from the secondary-transfer voltage source 210, and then by measuring a current passing through the secondary-transfer portion by a current detecting means 220 when the adjusting voltage is applied. By the ATVC, a correlation between the voltage and the current can be calculated.

Further, on the basis of the calculated correlation between the voltage and the current, a voltage V1 for causing a secondary-transfer target current It required for the secondary-transfer to flow is calculated. The secondary-transfer target current It is set on the basis of a matrix shown in Table 1.

TABLE 1

| WC*1 (g/kg) | 0.8 | 2 | 6 | 9 | 15 | 18 | 22 |
|---|---|---|---|---|---|---|---|
| STTC*2 (μA) | 32 | 31 | 30 | 30 | 29 | 28 | 25 |

*1"WC" represents water content.
*2"STTC" represents the secondary-transfer target current.

Table 1 is a table stored in a storing portion provided in the CPU circuit portion 150. This table sets and divides the secondary-transfer target current It depending on absolute water content (g/kg) in an atmosphere. This reason will be described. When the water content becomes high, a toner charge amount becomes small. Therefore, when the water content becomes high, the secondary-transfer target current It is set so as to become small. That is, when the water content is increased, the secondary-transfer target current is decreased. Incidentally, the absolute water content is calculated by the CPU circuit portion 150 from the temperature and relative humidity which are detected by the temperature and humidity sensor 207. Incidentally, in this embodiment, the absolute water content is used, but the water content is not intended to be limited to this. In place of the absolute water content, it is also possible to use the relative humidity.

Here, the voltage V1 for passing It is a voltage for passing It in the case where there is no recording material at the secondary-transfer portion. However, the secondary-transfer is carried out when there is the recording material at the secondary-transfer portion. Therefore, it is desirable that a resistance for the recording material is taken into account. Therefore, a recording material sharing voltage V2 is added to the voltage V1. The recording material sharing voltage V2 is set on the basis of a matrix shown in Table 2.

TABLE 2

| PLAIN PAPER | WC*1 | 0.8 | 2 | 6 | 9 | 15 | 18 | 22 |
|---|---|---|---|---|---|---|---|---|
| 64-79 (gsm) (UNIT: V) | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (gsm) | WC*1 | 0.8 | 2 | 6 | 9 | 15 | 18 | 22 |
| (UNIT: V) | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |

TABLE 2-continued

| 106-128 (gsm) | WC*1 | 0.8 | 2 | 6 | 9 | 15 | 18 | 22 |
|---|---|---|---|---|---|---|---|---|
| (UNIT: V) | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-150 (gsm) | WC*1 | 0.8 | 2 | 6 | 9 | 15 | 18 | 22 |
| (UNIT: V) | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represent the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage V2 depending on the absolute water content (g/kg) in an atmosphere and a recording material basis weight (g/m$^2$). When the basis weight is increased, the recording material sharing voltage V2 is increased. This is because when the basis weight is increased, the recording material becomes thick and therefore an electric resistance of the recording material is increased. Further, when the absolute water content is increased, the recording material sharing voltage V2 is decreased. This is because when the absolute water content is increased, the content of water contained in the recording material is increased, and therefore the electric resistance of the recording material is increased. Further, the recording material sharing voltage V2 is larger during automatic double-side printing and during manual double-side printing than during one-side printing. Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the CPU circuit portion 150 discriminate the basis weight.

A voltage (V1+V2) obtained by adding the recording material sharing voltage V2 to V1 for passing the secondary-transfer target current It is set, during the secondary-transfer step subsequent to the adjusting step by the CPU circuit portion 150, as a secondary-transfer target voltage Vt, for secondary-transfer, which is constant-voltage-controlled. That is, the CPU circuit portion 150 functions as a setting means for setting the secondary-transfer voltage. As a result, a proper voltage value is set depending on an adjusting voltage environment and a recording material thickness. Further, during the secondary-transfer, the secondary-transfer voltage is applied in a constant-voltage-controlled state by the CPU circuit portion 150, and therefore even when a width of the recording material is changed, the secondary-transfer is carried out in a stable state.

[Control of Electrostatic Image Forming Means for Optimizing Primary-Transfer]

In this embodiment, in order to form a proper secondary-transfer contrast, the CPU circuit portion 150 changes the voltage applied by the secondary-transfer voltage source 210.

For example, in the case where an absolute water content is 9 (g/kg), the CPU circuit portion 150 changes a sharing voltage V2 of the recording material from 800 V to 950 V in the case where the recording material of 150 (g/cm$^2$) in basis weight is subjected to one-side printing after the recording material of 64 (g/m$^2$) in basis weight is subjected to the one-side printing. Or, in the case where the absolute water content is 9 (g/kg), even when a condition such that the recording material of 64 (g/m$^2$) in basis weight is subjected to the one-side printing is the same, if a resistance of the outer secondary-transfer roller changes with time, the CPU circuit portion 150 changes V1 for passing the secondary-transfer target current It (25 μA). Or, even when the condition such that the recording material of 64 (g/m$^2$) in basis weight is subjected to the one-side printing is the same, the CPU circuit portion 150 changes the secondary-transfer target current It and the recording material sharing voltage between the case where the absolute water content is 9 (g/m$^2$) and the case where the absolute water content is 0.8 (g/kg).

However, in the primary-transfer-high-voltage-less system which is the constitution from which the voltage source (power source) exclusively for the primary-transfer is omitted, also a primary-transfer contrast is formed by using the secondary-transfer voltage source 210. For that reason, when the CPU circuit portion 150 changes the voltage applied by the secondary-transfer voltage source 210 in order to optimize the secondary-transfer electric field, in the case where the primary-transfer is carried out simultaneously with the secondary-transfer, when the potential of the intermediary transfer belt is changed, there is a liability that a primary-transfer defect is caused to occur.

Therefore, in this embodiment, in the case where the CPU circuit portion 150 changes the voltage applied by the secondary-transfer voltage source 210 in order to optimize the secondary-transfer, a voltage drop of the Zener diode is set at the Zener breakdown voltage. For that reason, even in the case where the voltage applied by the secondary-transfer voltage source 210 is changed by the CPU circuit portion 150 in order to optimize the secondary-transfer, the potential of the intermediary transfer belt is not changed. In addition, the CPU circuit portion 150 changes the image portion potential on the photosensitive drum in the case of necessity, and does not change the image portion potential on the photosensitive drum in the case of unnecessity.

For that reason, in the primary-transfer-HV-less system, even when the CPU circuit portion 150 changes the voltage applied by the secondary-transfer voltage source 210 in order to optimize the secondary-transfer, a change in primary-transfer electric field is suppressed. As a result, it is possible to form a proper primary-transfer contrast.

The primary-transfer contrast is set on the basis of a table of Table 3. Table 3 is the table stored in a storing portion provided in the CPU circuit portion 150, and shows a reference between the primary-transfer contrast and the ambient condition. This table sets and divides the primary-transfer contrast portion the colors (Y, M, C, Bk) and the ambient condition.

TABLE 3

| | WATER CONTENT (g/kg) | | | | | | |
|---|---|---|---|---|---|---|---|
| | 22 | 18 | 15 | 9 | 6 | 2 | 0.8 |
| Y | 390 | 435 | 470 | 490 | 515 | 525 | 540 |
| M | 350 | 395 | 430 | 450 | 475 | 485 | 500 |
| C | 350 | 395 | 430 | 450 | 475 | 485 | 500 |
| Bk | 300 | 345 | 380 | 400 | 425 | 435 | 450 |

For example, the case where the ambient condition in which the absolute water content is 9 (g/kg), the one-side printing of the recording material of 64 (g/m$^2$) in basis weight is selected by a user and then the one-side printing of the recording material of 150 (g/m$^2$) is selected by the user will be described. In this case, the sharing voltage V2 of the recording material changes from 800 V to 950 V, and therefore the secondary-transfer target voltage Vt changes. On the other hand, a thickness of the recording material does not relate to the primary-transfer, and therefore a proper primary-transfer contrast does not change.

Therefore, in order to optimize the secondary-transfer contrast, the CPU circuit portion 150 changes the voltage applied to the outer secondary-transfer roller by the secondary-transfer voltage source 210. However, the secondary-transfer is carried out in a range in which the voltage applied to the Zener diode maintains the Zener breakdown voltage, so that the potential of the intermediary transfer belt is kept constant at 300 V. Further, the electrostatic image forming condition of the electrostatic image forming means is maintained without charging the electrostatic image condition of the electrostatic image forming means. As a result, the primary-transfer contrasts for the respective colors of Y, M, C and K are maintained at proper values of 490 V, 450 V, 450 V and 400 V.

Next, e.g., the case where the one-side printing of the recording material of 64 (g/m$^2$) in basis weight is carried out in the ambient condition of 9 (g/kg) in absolute water content, and then is carried out in the ambient condition of 0.8 (g/kg) in absolute water content will be described.

In this case, as shown in Table 1 and Table 2, the CPU circuit portion 150 changes both the secondary-transfer target current It and the recording material sharing voltage V2. More specifically, a toner charge amount increases with a decrease in water content, and therefore the CPU circuit portion 150 changes the secondary-transfer target current It from 30 μA to 32 μA. Further, a resistance of the recording material increases with the decrease in water content contained in the recording material, and therefore the CPU circuit portion 150 changes the recording material sharing voltage V2 from 800 V to 900 V. For that reason, the secondary-transfer target voltage Vt increases. On the other hand, the toner charge amount increases with the decrease in water content, and therefore also the proper primary-transfer contrast increases. More specifically, as shown in Table 3, the proper primary-transfer contrast changes from 490 V to 540 V for Y, changes from 450 V to 500 V for M and C, and changes from 400 V to 500 V for Bk.

Therefore, even when the voltage applied by the secondary-transfer voltage source changes, in order to optimize the primary-transfer contrast for the primary-transfer carried out in parallel with the secondary-transfer, the CPU circuit portion 150 effects control as follows. That is, the CPU circuit portion 150 maintains the potential of the intermediary transfer belt at a constant value of 300 V. In addition, the CPU circuit portion changes the image portion potential of the photosensitive drum.

Here, the M color will be described as an example by using FIG. 2. (a) of FIG. 2 shows the case of the ambient condition of 9 (g/kg) in absolute water content, and (b) of FIG. 2 shows the case where the control is effected in the ambient condition of 0.8 (g/kg) in absolute water content.

In the case where the absolute water content is 9 (g/kg), in order to set a primary-transfer contrast Vtr for M at 450 V, the CPU circuit portion 150 sets a potential Vitb of the intermediary transfer belt at 300 V and also sets an image portion potential Vl1 of the photosensitive drum at Vl=300 (V)−450 V (V)=−150 V.

Here, when a developing contrast Vca is 100 V and an electrostatic image contrast Vcb is 300 V, the following holds.

Developing *Vdc:* −150 (V)−100 (V)=−250 (V)

Charging *Vd:* −150 (V)−300 (V)=−450 (V)

On the other hand, in the case of the ambient condition in which the absolute water content is 0.8 (g/kg), in order to set a primary-transfer contrast Vtr for M at 500 V, the CPU circuit portion 150 sets a potential Vitb of the intermediary transfer belt at 300 V and also sets an image portion potential Vl of the photosensitive drum at Vl=300 (V)−500 V (V)=−200 V.

Here, when a developing contrast Vca is unchanged at 100 V and an electrostatic image contrast Vcb is unchanged at 300 V, the following holds.

Developing *Vdc:* −200 (V)−100 (V)=−300 (V)

Charging *Vd:* −200 (V)−300 (V)=−500 (V)

Incidentally, the M color is described as the example, but also with respect to the respective colors of Y, C and Bk, the photosensitive drum potential and the developing bias can be determined similarly.

Incidentally, in this embodiment, when the image portion potential of the photosensitive drum is controlled, the CPU circuit portion 150 changes an output of the primary charger and the developing bias of the developing device, but does not change an output of the exposure device. For this reason, when the CPU circuit portion 150 controls the image portion potential of the photosensitive drum, the developing contrast and the electrostatic image contrast are unchanged. As a result, the influence on image density due to the change in developing contrast is suppressed. Further, generation of a problem such that a toner deposition onto a non-image region due to the charge in electrostatic image contrast with no change in potential difference between the developing bias and a non-image portion potential is suppressed. Further, in this embodiment, a constitution in which the CPU circuit portion 150 changes the developing bias for charging the image portion potential is employed. However, this embodiment is not intended to be limited to this constitution. It is also possible to employ a constitution in which the CPU circuit portion 150 changes the output of the exposure device for changing the image portion potential.

Embodiment 2

In Embodiment 1, a method of ensuring the primary-transfer contrast by adjusting the electrostatic image potential of the photosensitive drum relative to the belt potential of the intermediary transfer belt is used. However, from a characteristic of the photosensitive drum, the image portion potential and the non-image portion potential have charging limit values. That is, a region where a charge potential is not increased by charging by the charging means and a region where the non-image portion potential is not attenuated by the exposure by the exposure means exist.

Figure 5:
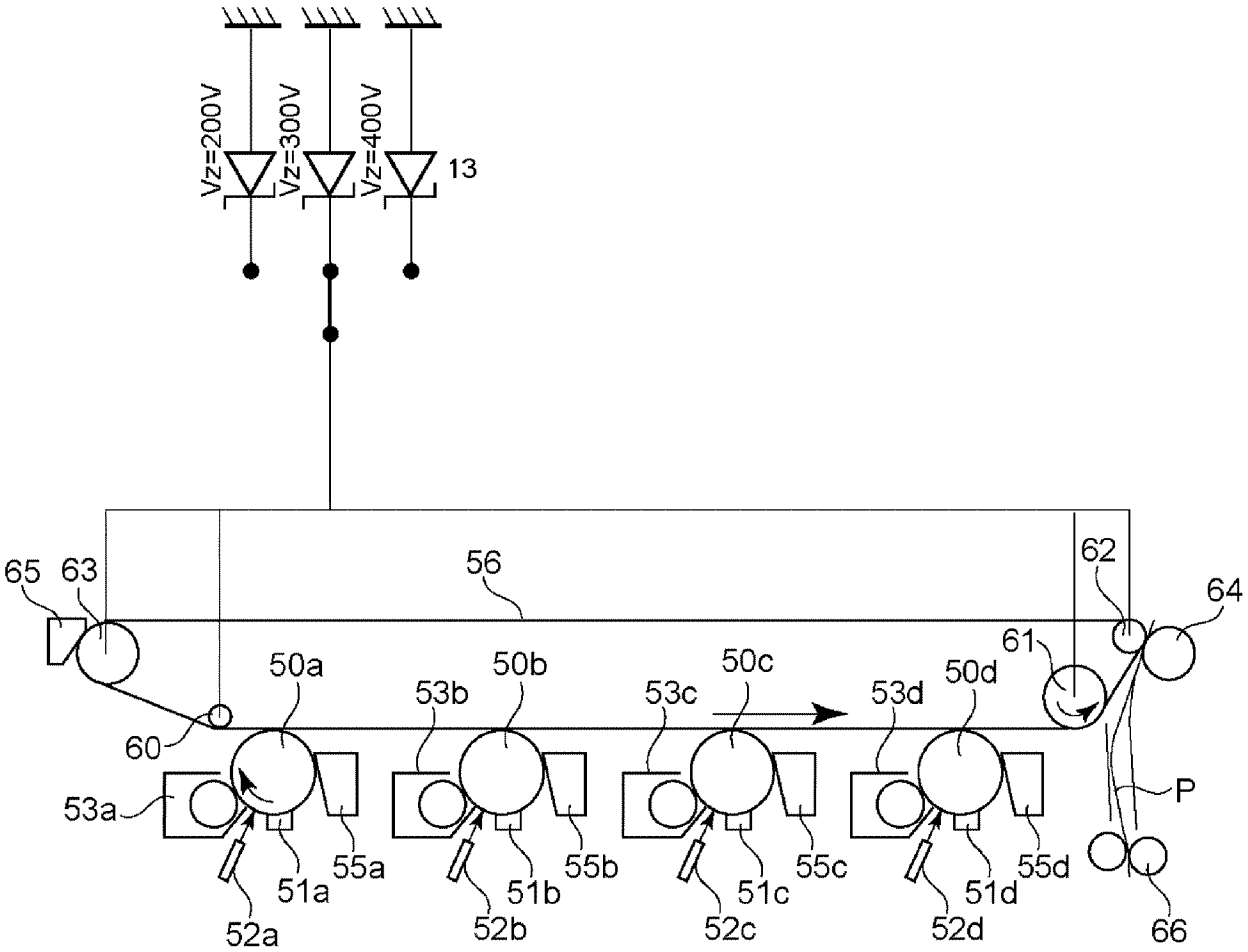
FIG. 5 is an illustration showing a basic structure in Embodiment 2.

Therefore, Embodiment 2 relates to correspondence in the case where the adjustment of the electrostatic image contrast reaches a charging limit of the photosensitive drum. For example, such a case is the case where the charge potential of the photosensitive drum is not increased and the case where the potential is not lowered after the exposure. In this embodiment, in the case where the adjustment of the electrostatic image contrast reaches the charging limit of the photosensitive drum, a switching member for switching electrical connection of a plurality of Zener diodes is provided as shown in FIG. 5, and the CPU circuit portion 150 controls the switching member. In this embodiment, the potential of the intermediary transfer belt is constituted so as to be switchable to 300 V, 400 V and 500 V. For example, in Embodiment 1, the CPU circuit portion 150 can increase the belt potential to 400 V by switching the Zener diode of 300 V in Zener breakdown voltage to the Zener diode of 400 V in Zener breakdown voltage.

Timing of control of the switching of the Zener diode is timing when the adjustment reaches the charging limit of the photosensitive drum for any of Y, M, C and K.

[Temperature Characteristic of Zener Diode]

In this embodiment, in order to stabilize the primary-transfer, the Zener diode is connected between the intermediary transfer belt and the ground, and in addition, during the primary-transfer, the CPU circuit portion 150 applies the voltage so that the voltage drop of the Zener diode is maintains the Zener breakdown voltage.

However, the Zener diode itself has a temperature characteristic such that the Zener breakdown voltage changes depending the temperature.

That is, a standard voltage of the Zener breakdown voltage is a value with respect to a predetermined reference temperature, and therefore at the predetermined reference temperature, the Zener breakdown voltage is the standard voltage. That is, at the predetermined reference temperature, the voltage drop of the Zener diode maintains the standard voltage. However, in the case where the temperature is different from the reference temperature, an actual Zener breakdown voltage is a value different from the standard voltage. That is, the voltage drop of the Zener breakdown voltage maintains the voltage different from the standard voltage. Then, the potential of the intermediary transfer member is a value different from a voltage determined by the standard voltage.

As a result, also the primary-transfer electric field between the intermediary transfer member and the image bearing member is deviated, and therefore, there is a liability that the deviation influences the primary-transfer. For example, there is a liability that a color tint of the image changes.

Therefore, in this embodiment, in order to suppress the influence on the primary-transfer, the potential deviation of the intermediary transfer member due to the temperature characteristic of the Zener diode is corrected. That is, portion information corresponding to the temperature characteristic of the Zener diode, the image portion potential on the photosensitive drum is changed.

correspondingly to the temperature charge of the Zener diode, the voltage to be applied to the outer secondary-transfer roller is controlled. In a constitution in which the voltage source exclusively for the primary-transfer is omitted for the cost reduction and in which the intermediary transfer member is connected to the Zener diode for stabilizing the primary-transfer, it is suppressed that the voltage applied to the Zener diode is less than the Zener breakdown voltage due to the temperature characteristic of the Zener diode.

Figure 6:
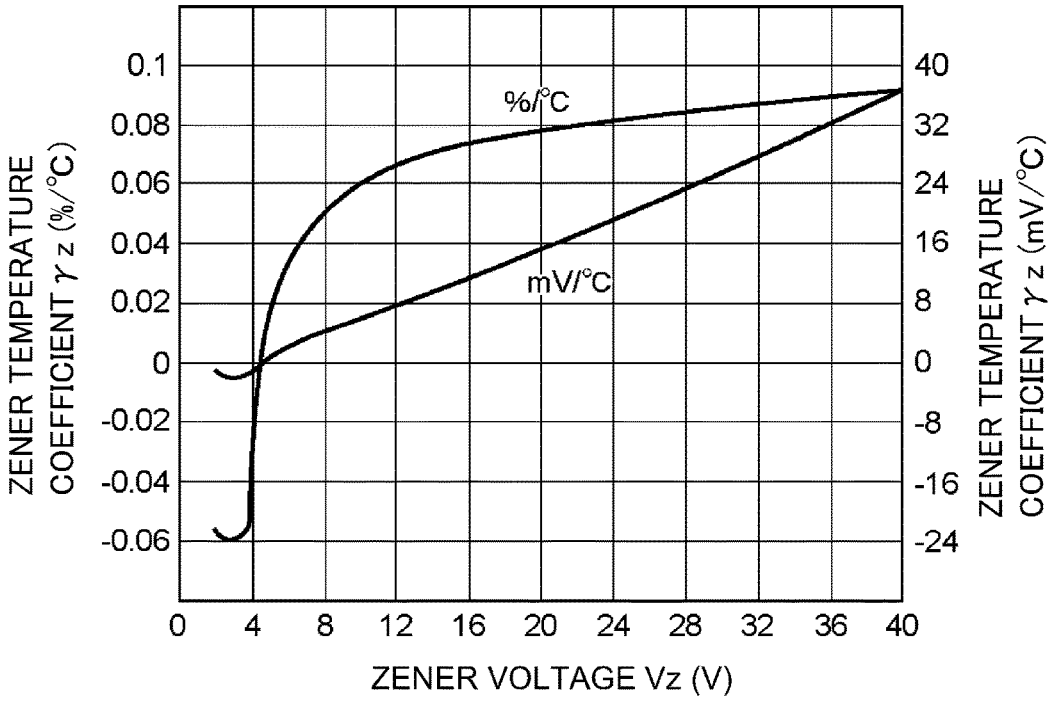
FIG. 6 is a temperature characteristic of a Zener diode.
Figure 6:
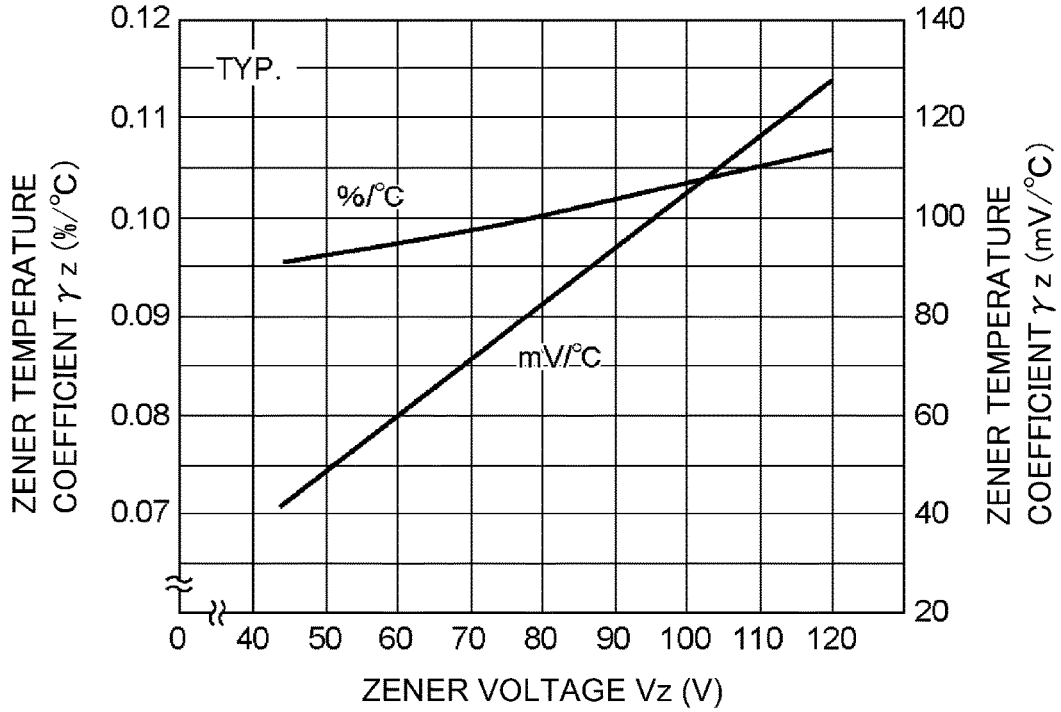

The Zener diode has a temperature characteristic such that a Zener breakdown voltage Vbr is changed with an ambient temperature even when an inflowing current is kept constant. FIG. 6 shows a relationship between the Zener breakdown voltage Vbr and a temperature coefficient γz at a reference temperature of 23° C. The Zener diode has a characteristic such that a value of the temperature coefficient γz becomes large with an increasing Zener breakdown voltage Vbr per one Zener diode.

[Calculation of Fluctuation Amount ΔVitb of Potential of Intermediary Transfer Member]

Here, the case where the potential Vitb of the intermediary transfer belt is maintained at 300 V by connecting two pieces of the Zener diode, in series, of 150 V in Zener breakdown voltage Vbr will be described.

First, in this embodiment, the Zener diode is disposed in the neighborhood of the temperature and humidity sensor in the image forming apparatus, so that the CPU circuit portion 150 can detect the ambient temperature in the neighborhood of the Zener diode in real time.

The ambient temperature inside the image forming apparatus reaches a highest state immediately after sheets are continuously fed in automatic double-side (printing) in a high-temperature and high-humidity environment (30° C., 80% RH), and increases up to about 50° C. On the other hand, immediately after the image forming apparatus is actuated in a low-temperature and low-humidity environment (15° C., 10% RH), the ambient temperature is approximately 15° C. That is, when these are compared, the ambient temperature in the image forming apparatus has a fluctuation range of about 35° C. Here, from FIG. 6, at the reference temperature of 23° C., the Zener breakdown voltage Vbr and the temperature coefficient γz provides a relation:

$$\gamma z = 1.1 \times Vbr - 5.0,$$

and therefore the temperature coefficient γz at Vbr=150 V is 160 mV/° C. As a result, the fluctuation amount ΔVitb, of the intermediary transfer belt 56, corresponding to a fluctuation range of 35° C. in ambient temperature is as follows. In the case of Vitb=300 V, $$160\ (\text{mV}/^\circ\ \text{C.}) \times 35 (^\circ\ \text{C.}) \times 2\ (\text{pieces}) = 11.2\ (\text{V}).$$

In the case of Vitb=450 V, $$160\ (\text{mV}/^\circ\ \text{C.}) \times 35\ (^\circ\ \text{C.}) \times 3\ (\text{pieces}) = 16.8\ (\text{V}).$$

Further, with respect to ΔVitb showing a deviation between a standard voltage (the Zener breakdown voltage at the reference temperature) and an actual Zener breakdown voltage at a predetermined temperature, in the case where the temperature is 50° C., $$160\ (\text{mV}/^\circ\ \text{C.}) \times (50-23)(^\circ\ \text{C.}) \times 2\ (\text{pieces}) = 8.6\ (\text{V}),$$

and in the case where the temperature is 15° C., $$160\ (\text{mV}/^\circ\ \text{C.}) \times (15-23)(^\circ\ \text{C.}) \times 2\ (\text{pieces}) = 2.5\ (\text{V}).$$

That is, the value of Vitb fluctuates depending on an ambient temperature, and therefore the deviation generates by ΔVitb relative to the transfer contrast Vtr set on the basis of setting of Table 3.

[Correcting Method of Transfer Contrast Vtr]

When the transfer contrast fluctuates by 10 V, a color tint fluctuation of a half-tone (image) in a highlight side becomes conspicuous. For that reason, there is a need to correct the fluctuation amount ΔVitb, of the potential Vitb of the intermediary transfer belt due to the fluctuation of the ambient temperature to ΔVitb<10 V.

Figure 7:
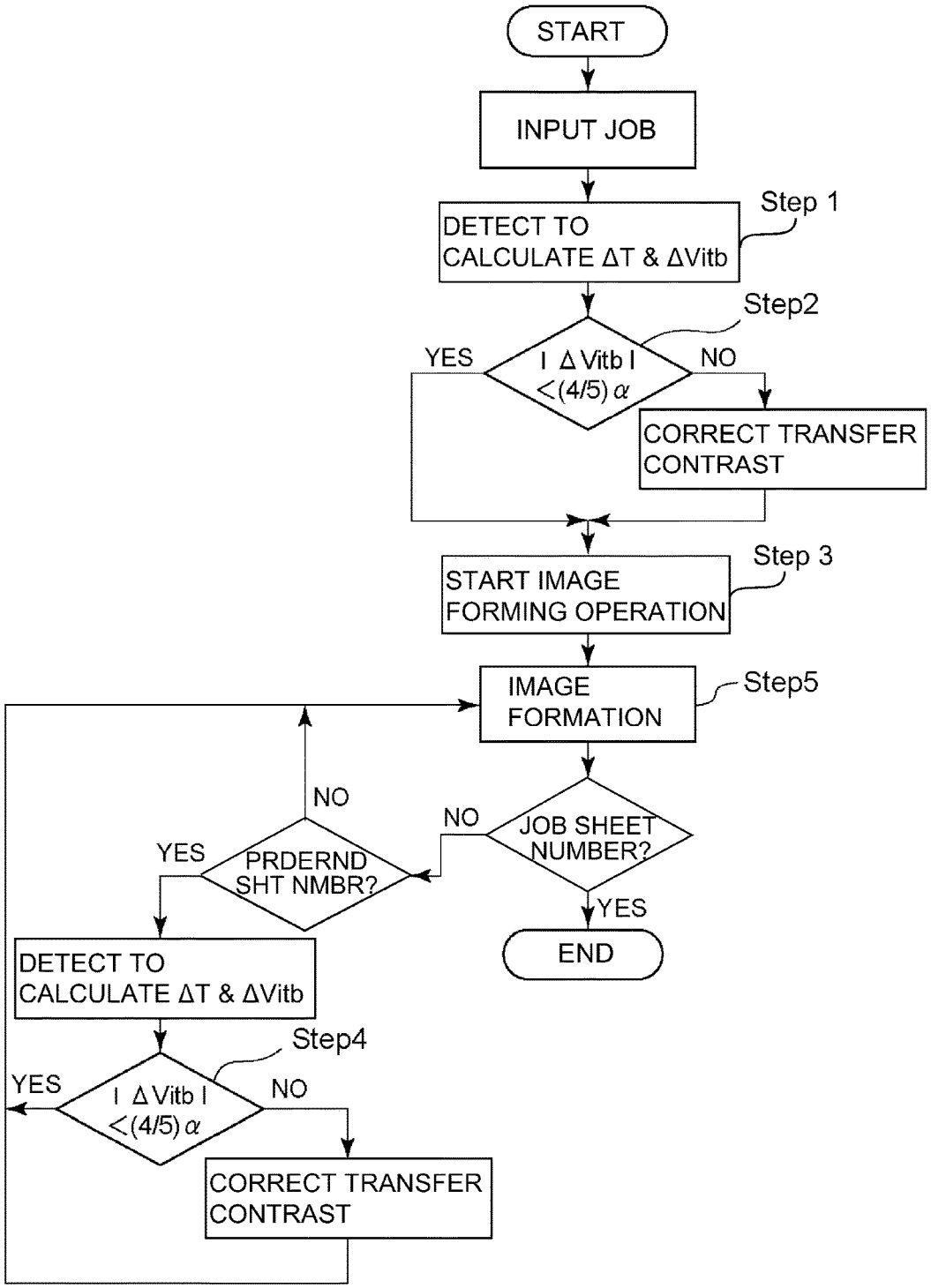
FIG. 7 is a flowchart for illustrating a correcting method of a primary-transfer contrast.

FIG. 7 shows a flowchart regarding a correcting method of the transfer contrast Vtr in this embodiment. The following flowchart is carried out by the CPU circuit portion 150.

First, immediately after a job is inputted from a user, the CPU circuit portion 150 detects an ambient temperature T0 in the neighborhood of the Zener diode 11 by the temperature and humidity sensor 207. At this time, from an ambient temperature fluctuation amount ΔT=T0−Ts, the fluctuation amount ΔVitb of Vitb is calculated. Here, Ts is the ambient temperature of 23° C. (Step 1). Next, the CPU circuit portion 150 discriminates, whether or not the correction for the transfer contrast Vtr is needed, by using a discriminating equation between the fluctuation amount ΔVitb of Vitb and a threshold α of the color tint fluctuation (Step 2). In the case of −(4/5)α<ΔVitb<(4/5)α/, the CPU circuit portion 150 discriminates that the fluctuation amount ΔVitb is small and thus the color tint fluctuation does not generate. Then, the CPU circuit portion 150 starts an image forming operation without making the correction of the transfer contrast Vtr (Step 3). In the case of ΔVitb≤−(4/5)α, the CPU circuit portion 150 discriminates that the fluctuation amount ΔVitb is large and thus there is a liability that the color tint is fluctuated. In this case, the potential Vitb of the intermediary transfer member becomes lower than a set voltage determined by the standard voltage. Therefore, in order to correct the image portion potential in a direction of extending the transfer contrast, the CPU circuit portion 150 increases an absolute value of the image portion potential. Thereafter, the CPU circuit portion 150 start the image forming operation (Step 3). In the case of (4/5)α≥ΔVitb, the CPU circuit portion 150 discriminates that ΔVitb is large and therefore there is a liability that the color tint is fluctuated. In this case, the potential Vitb of the intermediary transfer member becomes higher than the set voltage determined by the standard voltage, and therefore there is a liability that the transfer contrast becomes excessive. Therefore, the CPU circuit portion 150 decreases the absolute value of the image portion potential in order to correct the transfer contrast in a narrowing direction. Thereafter, the image forming operation is started (Step 3).

Further, in one job, when the number of sheets of the recording material on which the image is to be formed is large, the temperature in the apparatus gradually increases. As a result, when the potential fluctuation of the intermediary transfer member becomes large due to the temperature characteristic of the Zener diode, there is a liability that the fluctuation influences the primary-transfer. As a result, there is a liability that the color tint fluctuation generates between images formed in the same job. Therefore, subsequent to Step 3, in order to suppress the color tint fluctuation in one job, the CPU circuit portion 150 discriminates the presence or absence of the correction for the transfer contrast Vtr every predetermined number of sheets (Step 4). In the case of −(4/5)α<ΔVitb<(4/5)α, the CPU circuit portion 150 continues the image forming operation without making the correction of the transfer contrast Vtr (Step 5). In the case of (4/5)α≥ΔVitb, Vitb becomes higher than an estimated value, and therefore the CPU circuit portion 150 corrects the transfer contrast in the narrowing direction, and then continues the image forming operation (Step 5). After an end of the image forming operation, the CPU circuit portion 150 returns to Step 1.

Next, the correcting method of the transfer contrast Vtr will be described. As the correcting method, the CPU circuit portion 150 returns the transfer contrast Vtr to a proper value by shifting each of the non-image portion potential Vd, the developing bias Vdc and the image portion potential Vl by ΔVitb in a state in which the values of the developing contrast Vca and the electrostatic image contrast Vcb are maintained.

Table 4-1 to Table 4-3 are setting tables of the non-image portion potential Vd, the developing bias Vdc, the image portion potential Vl and the primary-transfer contrast Vtr in an initial state, during durability (test) of 10 K (1 K=1000 sheets of A4-size) and during durability test) of 20 K for the M color. Table 4-1 to Table 4-3 each shows a relationship among the non-image portion potential Vd, the developing bias Vdc, the image portion potential Vl, the primary-transfer contrast Vtr and the fluctuation amount ΔVitb of the potential of the intermediary transfer belt 56 in a certain ambient condition. Further, the fluctuation amount ΔVitb of the potential of the intermediary transfer belt 56 is a value in the case where the potential Vitb of the intermediary transfer belt 56 is maintained at 300 V by changing 2 pieces of the Zener diode 11 of 150 V in Zener breakdown voltage in series. For this reason, the threshold α=10 (V) for the color tint fluctuation is set.

TABLE 4-1

| | | WC*1 (g/m³) | | | | | | | | | | | | | |
|---|---|---|---|---|---|---|---|---|---|---|---|---|---|---|---|
| | | 22 | | 18 | | 15 | | 9 | | 6 | | 2 | | 0.8 | |
| AT*2 (° C.) | | 30 | 50 | 25 | 45 | 20 | 40 | 15 | 35 | 10 | 30 | 15 | 35 | 15 | 35 |
| Initial (before correction) | | | | | | | | | | | | | | | |
| M | Vd | −530 | −530 | −591 | −591 | −642 | −642 | −678 | −678 | −718 | −718 | −744 | −744 | −760 | −760 |
| | Vl | −140 | −140 | −185 | −185 | −220 | −220 | −240 | −240 | −265 | −265 | −275 | −275 | −290 | −290 |
| | Vdc | −330 | −330 | −391 | −391 | −442 | −442 | −478 | −478 | −518 | −518 | −544 | −544 | −560 | −560 |
| | Vtr | 440 | 440 | 485 | 485 | 520 | 520 | 540 | 540 | 565 | 565 | 575 | 575 | 590 | 590 |
| Vitb (set) | | 300 | 300 | 300 | 300 | 300 | 300 | 300 | 300 | 300 | 300 | 300 | 300 | 300 | 300 |
| ΔVitb | | 22 | 8.6 | 0.6 | 7.0 | −1.0 | 5.4 | −2.6 | 3.8 | −4.2 | 2.2 | −2.6 | 3.8 | −2.6 | 3.8 |
| CN*3 | | No | Yes | No | Yes | No | Yes | No | No | Yes | No | No | No | No | No |
| Initial (after correction) | | | | | | | | | | | | | | | |
| M | Vd | −530 | −521 | −591 | −584 | −642 | −636 | −678 | −678 | −722 | −718 | −744 | −744 | −760 | −760 |
| | Vl | −140 | −131 | −185 | −178 | −220 | −215 | −240 | −240 | −269 | −265 | −275 | −275 | −290 | −290 |
| | Vdc | −330 | −321 | −391 | −384 | −442 | −436 | −478 | −478 | −522 | −518 | −544 | −544 | −560 | −560 |
| | Vtr | 440 | 440 | 485 | 485 | 520 | 520 | 540 | 540 | 565 | 565 | 575 | 575 | 590 | 590 |

*1"WC" represents the water content.

*2"AT" represents the ambient temperature.

*3"CN represents correction necessity.

TABLE 4-2

| | | WC*1 (g/m³) | | | | | | | | | | | | | |
|---|---|---|---|---|---|---|---|---|---|---|---|---|---|---|---|
| | | 22 | | 18 | | 15 | | 9 | | 6 | | 2 | | 0.8 | |
| AT*2 (° C.) | | 30 | 50 | 25 | 45 | 20 | 40 | 15 | 35 | 10 | 30 | 15 | 35 | 15 | 35 |
| Durability: 20K | | | | | | | | | | | | | | | |
| M | Vd | −480 | −480 | −541 | −541 | −592 | −592 | −628 | −628 | −668 | −668 | −694 | −694 | −780 | −780 |
| | Vl | −140 | −140 | −185 | −185 | −220 | −220 | −240 | −240 | −265 | −265 | −275 | −275 | −290 | −290 |
| | Vdc | −280 | −280 | −341 | −341 | −392 | −392 | −428 | −428 | −468 | −468 | −494 | −494 | −580 | −580 |
| | Vtr | 440 | 440 | 485 | 485 | 520 | 520 | 540 | 540 | 565 | 565 | 575 | 575 | 590 | 590 |
| Vitb (set) | | 300 | 300 | 300 | 300 | 300 | 300 | 300 | 300 | 300 | 300 | 300 | 300 | 300 | 300 |
| ΔVitb | | 22 | 8.6 | 0.6 | 7.0 | −1.0 | 5.4 | −2.6 | 3.8 | −4.2 | 2.2 | −2.6 | 3.8 | −2.6 | 3.8 |
| CN*3 | | No | Yes | No | Yes | No | Yes | No | No | Yes | No | No | No | No | No |
| Durability: 20K (after crrection) | | | | | | | | | | | | | | | |
| M | Vd | −480 | −471 | −541 | −534 | −592 | −586 | −628 | −628 | −672 | −668 | −694 | −694 | −770 | −770 |
| | Vl | −140 | −131 | −185 | −178 | −220 | −215 | −240 | −240 | −269 | −265 | −275 | −275 | −290 | −290 |
| | Vdc | −280 | −271 | −341 | −334 | −392 | −386 | −428 | −428 | −472 | −468 | −494 | −494 | −570 | −570 |
| | Vtr | 440 | 440 | 485 | 485 | 520 | 520 | 540 | 540 | 565 | 565 | 575 | 575 | 590 | 590 |

TABLE 4-3

| | | WC*1 (g/m³) | | | | | | | | | | | | | |
|---|---|---|---|---|---|---|---|---|---|---|---|---|---|---|---|
| | | 22 | | 18 | | 15 | | 9 | | 6 | | 2 | | 0.8 | |
| AT*2 (° C.) | | 30 | 50 | 25 | 45 | 20 | 40 | 15 | 35 | 10 | 30 | 15 | 35 | 15 | 35 |
| Durability: 20K | | | | | | | | | | | | | | | |
| M | Vd | −480 | −480 | −541 | −541 | −592 | −592 | −628 | −628 | −668 | −668 | −694 | −694 | −780 | −780 |
| | Vl | −140 | −140 | −185 | −185 | −220 | −220 | −240 | −240 | −265 | −265 | −275 | −275 | −290 | −290 |
| | Vdc | −280 | −280 | −341 | −341 | −392 | −392 | −428 | −428 | −468 | −468 | −494 | −494 | −580 | −580 |
| | Vtr | 440 | 440 | 485 | 485 | 520 | 520 | 540 | 540 | 565 | 565 | 575 | 575 | 590 | 590 |

TABLE 4-3-continued

| | | WC*1 (g/m3) | | | | | | | | | | | | | |
|---|---|---|---|---|---|---|---|---|---|---|---|---|---|---|---|
| | | 22 | | 18 | | 15 | | 9 | | 6 | | 2 | | 0.8 | |
| AT*2 (° C.) | | 30 | 50 | 25 | 45 | 20 | 40 | 15 | 35 | 10 | 30 | 15 | 35 | 15 | 35 |
| Vitb (set) | | 300 | 300 | 300 | 300 | 300 | 300 | 300 | 300 | 300 | 300 | 300 | 300 | 300 | 300 |
| ΔVitb | | 22 | 8.6 | 0.6 | 7.0 | −1.0 | 5.4 | −2.6 | 3.8 | −4.2 | 2.2 | −2.6 | 3.8 | −2.6 | 3.8 |
| CN*3 | | No | Yes | No | Yes | No | Yes | No | No | Yes | No | No | No | No | No |
| | | Durability: 20K (after crrection) | | | | | | | | | | | | | |
| M | Vd | −480 | −471 | −541 | −534 | −592 | −586 | −628 | −628 | −672 | −668 | −694 | −694 | −780 | −780 |
| | Vl | −140 | −131 | −185 | −178 | −220 | −215 | −240 | −240 | −269 | −265 | −275 | −275 | −290 | −290 |
| | Vdc | −280 | −271 | −341 | −334 | −392 | −386 | −428 | −428 | −472 | −468 | −494 | −494 | −580 | −580 |
| | Vtr | 440 | 440 | 485 | 485 | 520 | 520 | 540 | 540 | 565 | 565 | 575 | 575 | 590 | 590 |

For example, in the initial state of the ambient condition of 22 (g/m$^3$) in absolute water content, the case where the ambient temperature is 30° C. and 50° C. will be described.

In the case of the ambient temperature of 30° C., the following holds.

$$\Delta Vitb=160\ (\text{mV/° C.})\times(30-23)(\text{° C.})\times 2\ (\text{pieces})=2.2\ (\text{V})$$

The fluctuation amount ΔVitb of the potential of the intermediary transfer belt 56 is 2.2 (V), and therefore is 8.0 (V) or less. The fluctuation amount ΔVitb is small, and therefore there is no liability that the fluctuation amount influences the color tint fluctuation. That is, the CPU circuit portion 150 is not required to correct Vitb.

On the other hand, in the case of the ambient temperature of 50° C., the following holds.

$$\Delta Vitb=160\ (\text{mV/° C.})\times(50-23)(\text{° C.})\times 2\ (\text{pieces})=8.6\ (\text{V})$$

The fluctuation amount ΔVitb of the potential of the intermediary transfer belt 56 is 8.6 (V), and therefore is 4.0 (V) or more. The fluctuation amount ΔVitb is small, and therefore there is a liability that the fluctuation amount influences the color tint fluctuation. Thereafter, it is desirable that the CPU circuit portion 150 corrects Vitb.

The potential Vitb of the intermediary transfer belt is:

$$Vitb=300+8.6=308.6\ \text{V}.$$

The potential Vitb of the intermediary transfer belt 56 fluctuates from 300 (V) to 308.6 (V), and therefore unless the image portion potential is changed, the primary-transfer contrast Vtr increases from 440 (V) as a set value to 448.6 (V). Therefore, the CPU circuit portion 150 makes the correction so that the absolute value of the image portion potential becomes small. That is, the CPU circuit portion 150 makes the correction of adding the fluctuation amount ΔVitb (8.6 V) to each of the set values of Vd, Vdc and Vl.

$$Vd\ (\text{after correction})=-530+8.6=-521\ (\text{V})$$

$$Vdc\ (\text{after correction})=-330+8.6=-321\ (\text{V})$$

$$Vl\ (\text{after correction})=-140+8.6=-131\ (\text{V})$$

In summary, the CPU circuit portion 150 corrects Vd from −530 (V) to −521 (V), Vdc from −330 (V) to −321 (V) and Vl from −140 (V) to −131 (V).

In this way, with respect to the predetermined water content, when the temperature in the apparatus becomes high, the CPU circuit portion 150 effects control so that the absolute value of the image portion potential becomes small.

Incidentally, in this embodiment, the color tint fluctuation threshold α=10 V is set, but there is no need to limit the threshold α to 10 V. Further, the set values Vd, Vdc, Vl and Vtr in Table 4-1 to Table 4-3 are values in the constitution in this embodiment. This embodiment is not intended to be limited to these numerical values. It is desirable that these values may appropriately set depending on a toner base material used, an external additive prescription for the toner, prescription of key parts (components) such as the photosensitive drums 50*a*, 50*b*, 50*c* and 50*d* and the intermediary transfer belt 56.

By the above, the CPU circuit portion 150 calculates the potential fluctuation amount of the intermediary transfer member generated depending on the temperature characteristic of the Zener diode 11, and can correct the deviation from the proper value of the primary-transfer contrast.

That is, the CPU circuit portion 150 changes the potential difference, between the predetermined voltage and the image portion potential, depending on a detection result of the detecting member.

As a result, it becomes possible to suppress the color tint fluctuation generated in the image such as the half-tone (image).

Incidentally, in this embodiment, depending on the fluctuation, in Zener breakdown voltage obtained depending on the detection result of the temperature and humidity sensor 207, the secondary-transfer voltage source changes the voltage to be applied to the outer secondary-transfer roller in the following manner.

In a period before the primary-transfer of a first sheet of the recording material is started and then the recording material reaches the secondary-transfer portion, the secondary-transfer is not carried out. Therefore, in order to suppress energization deterioration of the outer secondary-transfer roller, the secondary-transfer voltage source voltage which is lower than the secondary-transfer voltage and which is low to the possible extent while being capable of maintaining the Zener breakdown voltage is applied to the outer secondary-transfer roller. However, in the case where the Zener breakdown voltage changes due to the temperature change, in some cases, the Zener breakdown voltage cannot be maintained unless the voltage to be applied to the secondary-transfer roller is changed correspondingly to the change in Zener breakdown voltage by the secondary-transfer voltage source, so that there is a liability that the primary-transfer defect is caused to occur. Therefore, in this embodiment, the CPU circuit portion 150 changes, in a period which is a period in which the primary-transfer is carried out and the secondary-transfer is not carried out, depending on the detection result of the temperature and humidity sensor 207, the voltage to be applied to the outer secondary-transfer roller by the secondary-transfer voltage source.

Further, the secondary-transfer is not carried out similarly also in a period which is a period in which the primary-transfer is carried out and in which an intermediary transfer member region corresponding to a region between a recording material and a recording material in the case where images are continuously formed is in the secondary-transfer position.

Therefore, the CPU circuit portion 150 changes, depending on the detection result of the temperature and humidity sensor 207, the voltage to be applied to the outer secondary-transfer roller by the secondary-transfer voltage source in the period which is a period in which the primary-transfer is carried out and in which an intermediary transfer member region corresponding to a region between a recording material and a recording material in the case where images are continuously formed is in the secondary-transfer position.

Further, in a period in which the recording material exists at the secondary-transfer portion and in which the secondary-transfer is carried out, in the case where the Zener breakdown voltage is changed due to the temperature change, the secondary-transfer contrast is changed unless the voltage to be applied to the outer secondary-transfer roller by the secondary-transfer voltage source is changed correspondingly to the change in Zener breakdown voltage.

This reason is because the secondary-transfer contrast is the potential difference between the outer secondary-transfer roller and the inner secondary-transfer roller, but the potential of the inner secondary-transfer roller is the same potential as the Zener breakdown voltage.

Therefore, in this embodiment, the CPU circuit portion 150 changes, depending on the detection result of the temperature and humidity sensor, the potential difference between the Zener breakdown voltage and the voltage to be applied to the outer secondary-transfer roller by the secondary-transfer voltage source.

Incidentally, in this embodiment, a constitution in which the image portion potential is changed depending on the temperature characteristic of the Zener diode is employed, and therefore this embodiment is particularly effective in a constitution in which an inexpensive Zener diode such that a temperature characteristic thereof is large is used. Of course, the present invention is not intended to be limited to the constitution in which the inexpensive Zener diode such that the temperature characteristic thereof is large is used. This embodiment is also applicable to a constitution in which a Zener diode showing a small temperature change in Zener breakdown voltage Vbr is used.

Incidentally, in this embodiment, a constitution in which the temperature and humidity sensor 207 is disposed as the detecting means for detecting information corresponding to the temperature of the Zener diode 11 is employed. Of course, this embodiment is not intended to be limited to this constitution.

It is also possible to employ a constitution in which the information corresponding to the temperature of the Zener diode 11 is detected by counting the number of sheets of the recording material on which the image is formed by a single image forming job.

Further, it is also possible to employ a constitution in which the information corresponding to the temperature of the Zener diode 11 is detected on the basis of the relationship between the current passing through the secondary-transfer portion and the voltage applied to the secondary-transfer roller.

Or, it is also possible to employ a constitution in which the information corresponding to the temperature of the Zener diode 11 is detected on the basis of an energization period of the image forming apparatus.

Incidentally, in this embodiment, even when the potential of the intermediary transfer belt is changed depending on the temperature characteristic of the Zener diode is employed, in order to suppress the influence on the primary-transfer defect, the image portion potential is changed depending on the temperature characteristic of the Zener diode. Further, it is desirable that it can be suppressed that the voltage applied to the Zener diode is less than the Zener breakdown voltage due to the temperature characteristic of the Zener diode. Therefore, it is also possible to employ a constitution in which the applied voltage is changed depending on the temperature characteristic of the Zener diode. That is, it is also possible to employ a constitution in which the image portion potential is changed depending on the temperature characteristic of the Zener diode, and at the same time also the applied voltage is changed.

Incidentally, in this embodiment, the image forming apparatus for forming the electrostatic image by the electrophotographic type is described, but this embodiment is not intended to be limited to this constitution. It is also possible to use an image forming apparatus for forming the electrostatic image by an electrostatic force type, not the electrophotographic type.

Embodiment 2

Figure 8:
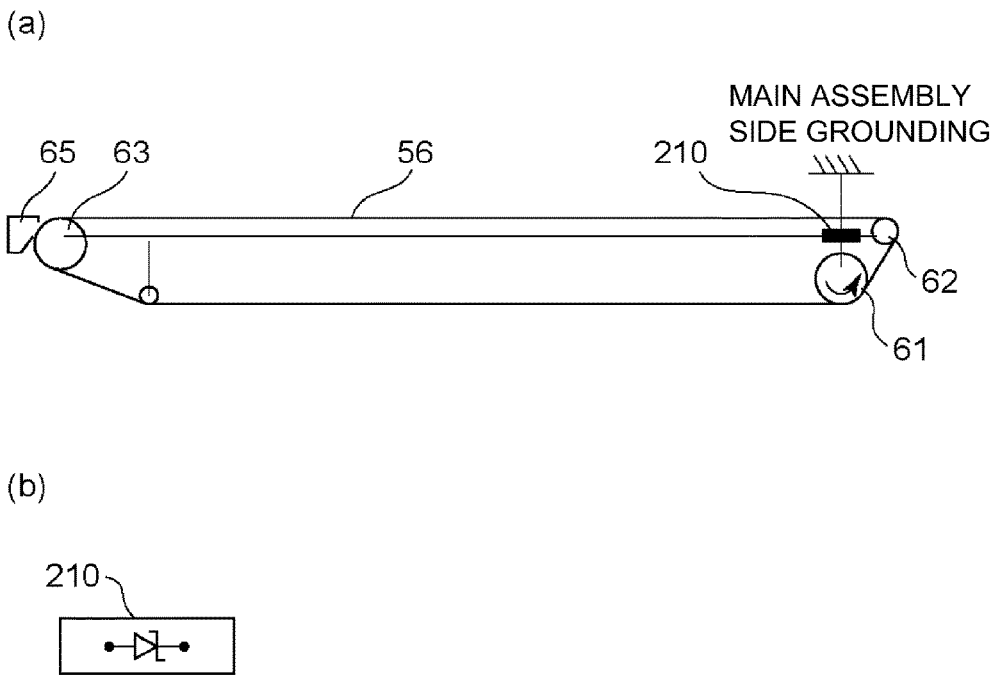
FIG. 8 is a view for illustrating an arrangement relationship between a Zener diode and a temperature sensor in Embodiment 3.

In this embodiment, also the temperature characteristic of the Zener diode was detected by utilizing the temperature and humidity sensor 207 disposed in the neighborhood of the secondary-transfer portion and the fixing device in order to detect the temperature characteristic of the ZD. However, when an exchange property of the intermediary transfer belt is taken into consideration, a constitution in which the Zener diode 11 is provided inside the intermediary transfer belt unit is preferred. Further, when also detection accuracy of the temperature characteristic of the Zener diode is taken into consideration, it is preferable that a temperature sensor is added just in the neighborhood of the Zener diode 11. Therefore, in Embodiment 2, a substrate 210 in which the Zener diode 11 is arranged is disposed at an inner belt surface of the intermediary transfer belt in a rear surface side of the image forming apparatus main assembly as shown in (a) and (b) of FIG. 8. The grounding of the Zener diode 11 has a constitution in which the Zener diode 11 can contact the ground in the apparatus main assembly side when the intermediary transfer belt unit is incorporated in the image forming apparatus main assembly. Further, a temperature sensor 208 other than the temperature and humidity sensor 207 was disposed in a range within 5 cm from the substrate 210 in which the Zener diode 11 was provided.

As a result, the exchange property of the intermediary transfer belt unit is improved, and the temperature characteristic of the Zener diode 11 is detectable at high accuracy.

By the above, the potential fluctuation amount of the intermediary transfer member generated by the temperature characteristic of the Zener diode 11 is calculated, and it is possible to correct the deviation of the primary-transfer contrast from the proper value. As a result, it becomes possible to suppress the color tint fluctuation generated in the image such as the half-tone (image).

Incidentally, this embodiment is described with reference to the image forming apparatus for forming the electrostatic image by the electrophotographic type, but this embodiment is not intended to be limited to this constitution. It is also possible to use an image forming apparatus for forming the electrostatic image by the electrostatic force type, not the electrophotographic type.

INDUSTRIAL APPLICABILITY

According to the present invention, in a constitution in which a power source exclusively for primary-transfer is omitted in order to reduce a cost, even when a voltage applied by a power source for the secondary-transfer is changed in order to properly carry out the secondary-transfer, it is possible to suppress generation of a primary-transfer defect.

The invention claimed is:

1. An image forming apparatus comprising:

a photosensitive member;

an image forming portion configured to form an electrostatic image on the photosensitive member to deposit a toner image on an image portion of the electrostatic image;

an intermediary transfer member configured to carry the toner image primary transferred from the photosensitive member at a primary-transfer position;

a transfer member provided contactable to an outer peripheral surface of the intermediary transfer member and configured to secondary transfer the toner image from the intermediary transfer member onto a recording material at a secondary-transfer position;

a constant-voltage element electrically connected between the intermediary transfer member and a ground potential, said constant-voltage element being configured to maintain a predetermined voltage by passing of a current therethrough;

a power source configured to form both of a secondary-transfer electric field at the secondary-transfer position and a primary-transfer electric field at the primary-transfer position by applying a voltage to the transfer member to pass the current through the constant voltage element from the transfer member via the intermediary transfer member;

a detecting member configured to detect a humidity in an ambient condition; and a controller configured to control a potential of the electrostatic image depending on a detection result of the detecting member.

2. An image forming apparatus according to claim 1, wherein the constant-voltage element is a Zener diode or a varistor.

3. An image forming apparatus according to claim 2, wherein the predetermined voltage is a breakdown voltage of the constant-voltage element.

4. An image forming apparatus according to claim 1, wherein said detecting member detects information corresponding to a temperature of said constant-voltage element.

5. An image forming apparatus according to claim 1, wherein said detecting member is provided in a neighborhood of said constant-voltage element.

6. An image forming apparatus according to claim 1, wherein said detecting member detects a temperature of said constant-voltage element.

7. An image forming apparatus according to claim 1, wherein said controller changes a potential difference between the predetermined voltage and the potential of the image portion depending on the detection result of said detecting member.

8. An image forming apparatus according to claim 1, wherein the predetermined voltage changes depending on the detection result of said detecting member.

9. An image forming apparatus according to claim 1, wherein said controller changes the voltage applied to said transfer member by said power source depending on the detection result of said detecting member, in a period in which the primary-transfer is carried out and in which the secondary-transfer is not carried out.

10. An image forming apparatus according to claim 9, wherein said controller changes the voltage applied to said transfer member by said power source depending on the detection result of said detecting member, in a period in which the primary-transfer is carried out and in which a region of said intermediary transfer member corresponding to a region between the recording material and a recording material in the case where images are continuously formed is in the secondary-transfer position.

11. An image forming apparatus according to claim 1, wherein said controller changes a depending on difference between the predetermined voltage and the voltage applied to said transfer member by said power source, depending on the detection result of said detecting member.

12. An image forming apparatus according to claim 1, wherein said controller calculates an absolute water content in air from temperature of the air and the humidity detected by said detecting member, and controls the potential of the image portion so than an absolute value of the potential of the image portion when the detection result is a first absolute water content is smaller than an absolute value of the potential of the image portion when the detection result is a second absolute water content smaller than the first absolute water content.

13. An image forming apparatus according to claim 1, wherein the intermediary transfer member has a structure of two layers or more, and a volume resistivity of the layer in an outer peripheral surface side is higher than a volume resistivity of the layer in an inner peripheral surface side.

14. An image forming apparatus according to claim 1, wherein the intermediary transfer member is an intermediary transfer belt, and the image forming apparatus comprises a plurality of stretching members for stretching the intermediary transfer belt in contact with an inner peripheral surface of the intermediary transfer belt.

15. An image forming apparatus according to claim 14, wherein said constant-voltage element is connected between each of said plurality of stretching members and the ground potential.

16. An image forming apparatus according to claim 1, said image forming portion comprising:

a charging member to which a charging bias having a predetermined voltage is applied for electrically charging said photosensitive member; and an exposure member for exposing said photosensitive member, charged by said charging member, to light at a predetermined light quantity, wherein said controller controls the potential of the electrostatic image by controlling at least one of the voltage of the charging bias or the light quantity of the exposure member, depending on the detection result of said detecting member.

17. An image forming apparatus according to claim 1, comprising:

a plurality of said constant-voltage elements electrically connected between said intermediary transfer member and the ground potential; and a switching member for switching electrical connection of said plurality of constant-voltage elements, wherein said controller controls said switching member depending on the detection result of said detecting member.

* * * * *